US005555690A

United States Patent [19]

Cosentino

[11] Patent Number: 5,555,690

[45] **Date of Patent: *Sep. 17, 1996**

[54] TILE MOUNTING SYSTEM

[76] Inventor: Edward Cosentino, P. O. Box 470, Marble, N.C. 28905

[ * ] Notice: The term of this patent shall not extend beyond the expiration date of Pat. No. 5,417,050.

[21] Appl. No.: 446,907

[22] Filed: May 17, 1995

Related U.S. Application Data

[63] Continuation of Ser. No. 37,292, Mar. 26, 1993, Pat. No. 5,417,050, which is a continuation-in-part of Ser. No. 787, 674, Nov. 4, 1991, abandoned, which is a continuation of Ser. No. 513,801, Apr. 24, 1990, abandoned.

[51] Int. Cl.[6] ..... E04B 2/00

[52] U.S. Cl. ..... 52/506.08; 52/235; 52/391

[58] Field of Search ..... 52/390, 391, 392, 52/596, 598, 597, 506, 511, 513, 235, 506.08

[56] References Cited

U.S. PATENT DOCUMENTS

| | | | |
|---|---|---|---|
| 2,238,488 | 4/1941 | Foskett | 72/118 |
| 3,563,578 | 2/1971 | Meller | 287/20.924 |
| 4,009,549 | 3/1977 | Hala | 52/506 |
| 4,020,610 | 5/1977 | Alexander | 52/511 |
| 4,074,486 | 2/1978 | Grearson | 52/235 |
| 4,307,551 | 12/1981 | Crandell | 52/235 |
| 4,422,275 | 12/1983 | Baetje | 52/509 |
| 4,423,576 | 1/1984 | Farina et al. | 52/235 |
| 4,503,654 | 3/1985 | Cosentino | 52/747 |
| 4,506,482 | 3/1985 | Pracht et al. | 52/235 |
| 4,571,910 | 2/1986 | Cosentino | 52/391 |
| 4,662,145 | 5/1987 | Tanikawa et al. | 52/745 |
| 4,685,263 | 8/1987 | Ting | 52/235 |
| 4,744,191 | 5/1988 | Fricker | 52/702 |
| 4,768,322 | 9/1988 | Kafarowski | 52/235 |
| 4,783,941 | 11/1988 | Loper et al. | 52/235 |
| 4,899,508 | 2/1990 | Biebuyck | 52/235 |
| 5,048,254 | 9/1991 | Merlau | 52/475 |
| 5,239,788 | 8/1993 | Saito | 52/235 |

*Primary Examiner*—Carl D. Friedman
*Assistant Examiner*—Creighton Smith
*Attorney, Agent, or Firm*—Brinks Hofer Gilson & Lione

[57] ABSTRACT

A tile mounting system for mounting tiles of stone or other material to a supporting body in a fixed position relative to the supporting body and, at the same time, for anchoring the tiles to the supporting body. The tile mounting system includes a tile having a front face and a rear face, the rear face of the tile having at least one groove therein, at least a portion of which is undercut in cross-section; and an anchor member for both mounting and anchoring the tile to the supporting body. The anchor member includes an insert portion for being fixedly secured within the undercut portion of the at least one groove, and an attachment portion extending from the insert portion in a direction substantially perpendicular to the rear face of the tile when the insert portion is secured within the at least one groove, the attachment portion preferably being at least partially threaded for being threadedly attached to said supporting body.

9 Claims, 7 Drawing Sheets

TILE MOUNTING SYSTEM

This application is a continuation, of application Ser. No. 08/037,292, filed Mar. 26, 1993 now U.S. Pat. No. 5,417,050, which is a continuation-in-part of prior application Ser. No. 07/787,674 filed Nov. 4, 1991 (now abandoned), which is a continuation of prior application Ser. No. 07/513,801 filed Apr. 24, 1990 (now abandoned).

BACKGROUND OF THE INVENTION

The present invention relates generally to a tile mounting system and, more particularly, to a system for mounting tiles of stone or other appropriate material to diverse types of supporting structures.

There is substantial interest in the construction industry for prefabricated systems to facilitate the covering of walls, ceilings and other surfaces with marble, ceramic and other natural or artificial stone materials. In this regard, it is known, to manufacture such materials in the form of slabs or "tiles" of rectangular or other polygonal shape which can be mounted to a supporting surface one by one to form an array of tiles for covering the surface.

Typically, the tiles are affixed to and locked in position on the supporting surface by being bonded to a bed of cement mortar or other bonding agent which has been initially applied to the supporting surface. In connection with this procedure, applicant's prior U.S. Pat. No. 4,571,910 discloses an apparatus for laying an array of tiles onto a supporting surface which includes a plurality of spacer elements which extend between adjacent tiles in such a manner as to ensure that all the tiles lie in a common plane and that the spacing between adjacent tiles is accurate and uniform throughout the array.

Because of their substantial weight, it is also usually desirable to firmly anchor the tiles to the wall or other supporting body on which they are mounted. In U.S. Pat. No. 4,571,910, the tiles are anchored by S-shaped anchoring elements which extend from the spacer elements into holes formed in the supporting body and which are fixed in the holes by filling the holes with cement mortar.

SUMMARY OF THE INVENTION

The present invention provides a tile mounting system which further facilitates the mounting of tiles to a supporting body, and which includes a mounting member or anchor that both mounts a tile in a fixed position relative to the supporting body and, at the same time, firmly anchors the tile to the supporting body.

According to the present invention, a tile mounting system is provided which comprises a tile having a front face and a rear face, the rear face of the tile having at least one groove therein at least a portion of which is undercut in cross-section; and an anchor member for both mounting and anchoring the tile to a supporting body, the anchor member including an insert portion for being fixedly secured within the undercut portion of the at least one groove, and an attachment portion extending from the insert portion in a direction substantially perpendicular to the rear face of the tile when the insert portion is secured within the at least one groove, the attachment ! portion being at least partially threaded for being threadedly attached to the supporting body.

In the present invention, fixedly securing the insert portion of the anchor member within the undercut groove fixes the position of the tile with respect to the anchor member, while attaching the threaded attachment portion of the anchor member to the supporting body anchors and fixes the position of the anchor member to the supporting body. Accordingly, with the system of the present invention, the tile is simultaneously fixed in position with respect to the supporting body and is firmly anchored to the supporting body.

In accordance with one presently preferred embodiment of the invention, the insert portion of the anchor member comprises a formed wire clip that is fixedly secured within the undercut portion of the groove by being force-fit thereinto, and the attachment portion comprises a threaded screw or bolt which extends through an opening in the formed wire clip and which is adapted to be screwed into or bolted to the supporting body. In this embodiment, the undercut groove preferably extends from an edge of the tile, and the formed wire clip includes a projecting section which projects out of the groove beyond the edge of the tile to be received in a corresponding undercut groove extending from an edge Of an adjacent tile to permit two tiles to be mounted and anchored together to the supporting body.

In accordance with a second presently preferred embodiment of the invention, the insert portion of the anchor member comprises a conical-shaped insert portion that is positioned in the groove and fixedly secured therein by external locking means; and the attachment portion comprises a threaded rod integral with and extending from the insert portion which is adapted to be bolted or otherwise fastened to the supporting body. In this embodiment, the undercut groove can be formed at any desired location in the rear face of the tile and may or may not extend to an edge of the tile to provide substantial flexibility in mounting tiles to supporting bodies of diverse type.

In accordance with the second presently preferred embodiment, the conical-shaped insert portion comprises a conical-shaped body integral with and extending from an end of the rod-shaped attachment portion and having a side wall which extends outwardly from the rod-shaped attachment portion at an angle of from about 12 degrees to about 15 degrees, most preferably, at an angle of about 14 degrees. In addition, the undercut groove is provided with a side surface which is slanted or tapered at the same angle as the side wall of the conical-shaped insert portion so that the conical-shaped insert portion will accurately engage and mate with the side wall of the groove; and, also, the groove is cut to a depth in the tile equal to the height of the conical-shaped insert portion such that the conical-shaped insert portion is fully received within the groove without any of the attachment portion being received within the groove.

With this construction,.a significant increase in anchoring strength is provided relative to known tile mounting systems which frequently utilize conventional off-the-shelf type fasteners to attach tiles to a supporting surface.

In accordance with yet a further embodiment of the present invention, the insert portion comprises an elongated solid body having a lateral cross-section configured to be substantially the same shape and size as that of the undercut groove so as to substantially fully fill the undercut groove when inserted therein. Such a configuration also provides a substantial increase in anchoring strength relative to known tile mounting apparatus.

According to a further aspect of the invention, the tile mounting system further includes an improved bit for drilling a groove having a dovetail or undercut profile in a marble or other natural or artificial stone tile without it being necessary to start the groove at an edge of the tile. The dovetail drill bit of the present invention permits an undercut groove to be drilled at any desired location in the rear face of a tile in a quick, efficient manner.

Further advantages and specific details of the invention will be set forth hereinafter in conjunction with the following detailed description of presently preferred embodiments thereof.

DETAILED DESCRIPTION OF THE PREFERRED EMBODIMENTS

Figure 1:
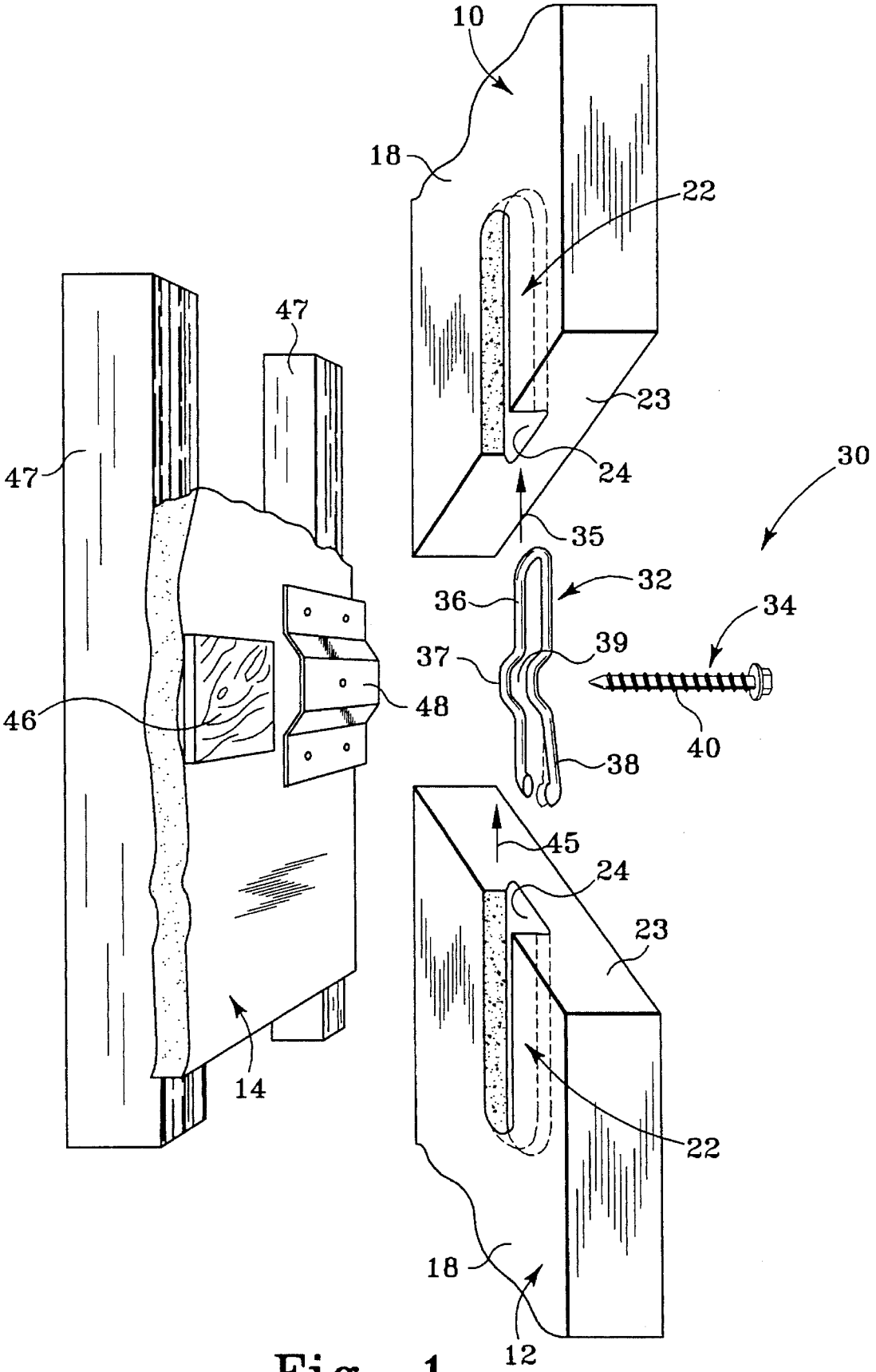
FIG. 1 is an exploded perspective view illustrating a tile mounting system according to a first presently preferred embodiment of the invention.

FIGS. 1–4 illustrate a tile mounting system according to a first presently preferred embodiment of the invention. As shown in FIG. 1, a pair of adjacent tiles such as rectangular marble tiles 10 and 12 are adapted to be mounted to a supporting body such as a wall 14. Each tile is substantially identical and has a smoothly polished, decorative front face 16 and an unfinished rear face.

Figure 3:
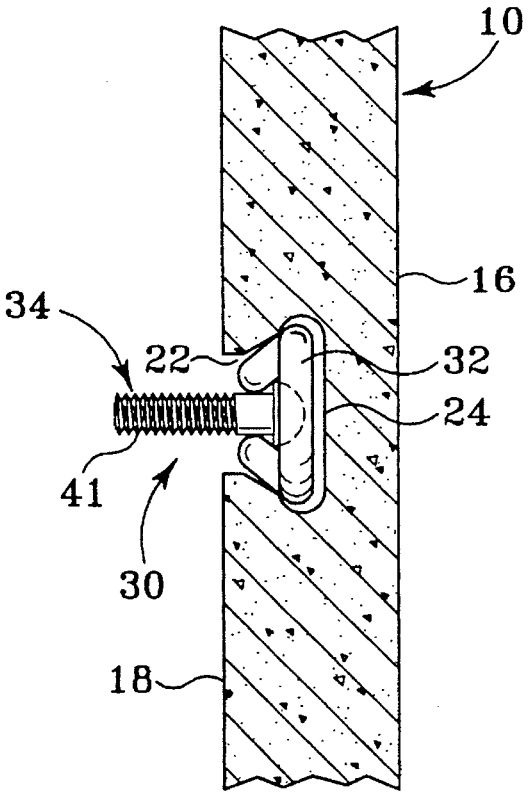
FIG. 3 is a cross-sectional view looking in the direction of arrow 3—3 in FIG. 2.

As best shown in FIG. 1, the rear face 18 of each tile is provided with at least one elongated groove 22 which extends from an edge 23 of the tile toward the middle of the rear face in a direction perpendicular to the edge 23. As shown in FIGS. 1 and 3, groove 22 has a dovetail or undercut profile such that it is wider adjacent the bottom surface 24 of the groove than at the top of the groove where the groove opens into the rear face of the tile. The distance between the bottom surface 24 of the groove and the front face 16 of the tile is exactly the same for all tiles and for all grooves in a tile.

Tiles 10 and 12 are adapted to be mounted to wall 14 by an anchor member Which is designated by reference number 30 and which generally includes an insert portion 32 and an attachment portion 34.

Figure 4A:
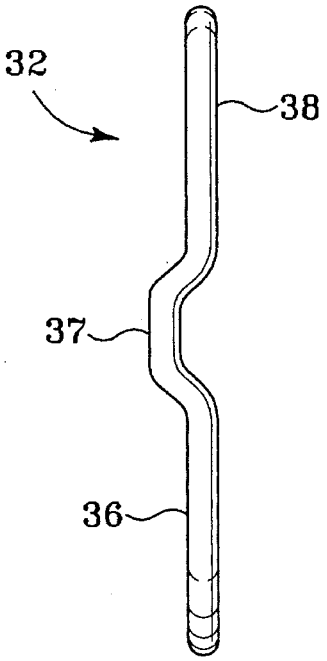
FIGS. 4A and 4B are side and plan views, respectively, of the insert portion of the anchor member of FIGS. 1–3.
Figure 4B:
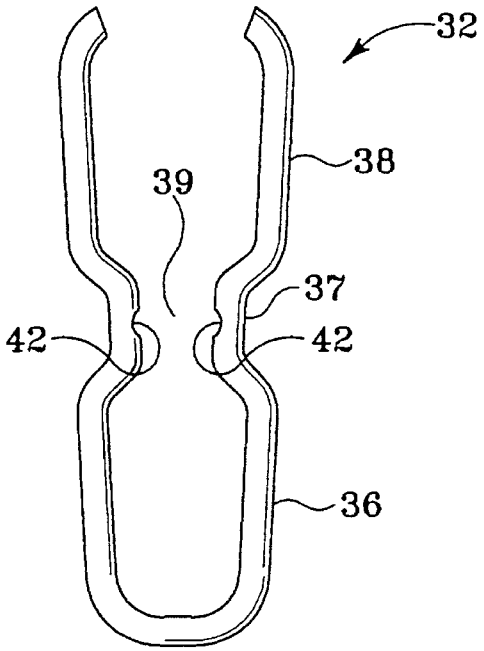

As best shown in FIGS. 1, 4A and 4B, insert portion 32 comprises a formed wire clip which is of generally U-shaped configuration. More particularly, wire clip 32 is formed to include a base section 36 defined generally by the closed base of the U-shaped wire, a projecting section 38 defined generally by the ends of the arms of the U-shaped wire, and a raised attachment portion receiving section 37 between the base section and the projecting section. AS shown in FIGS. 4A and 4B, the attachment portion receiving section is formed by bending a central portion of each arm of the wire upwardly and inwardly to define a narrowed space 39 therebetween.

Figure 2:
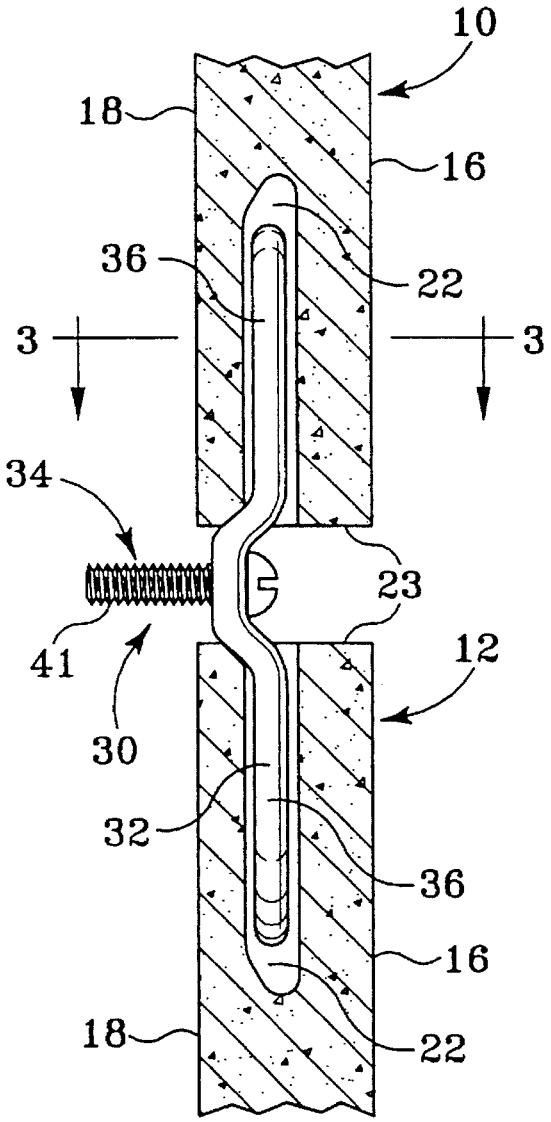
FIG. 2 is a view, partially in section, illustrating the tile mounting system of FIG. 1 in assembled form.

Attachment portion 34 comprises an externally threaded fastener such as a self-tapping screw 40 as shown in FIG. 1, or a threaded bolt 41 as shown in FIGS. 2 and 3. Attachment portion 34 is adapted to extend through narrowed space 39 of attachment portion supporting section 37 of wire clip 32 as shown in FIGS. 2 and 3. A portion of the inner surface of each arm can be drilled out to form facing curved surfaces 42 to define a "hole" through which the attachment portion can be screwed to retain the attachment portion to the wire clip.

To mount tiles 10 and 12 to wall 14, base section 36 of wire clip 32 is first inserted into groove 22 in tile 10 from the edge 23 thereof as indicated by arrow 35. Clip 32 can be formed, for example, from · 8 gauge stainless steel and iS spring-loaded such that when inserted, the base section of the clip will be fixedly secured in the groove by the force fit established between the base section and the walls of the groove. As shown in FIG. 2, the base section is inserted into groove 22 until the edge 23 of the panel impinges against raised attachment member receiving section 37 of the clip.

Attachment portion 34 is then screwed into and through opening 39 of the wire clip and fastened to a supporting body such as wall 14 in FIG. 1. In FIG. 1 wall 14 comprises a drywall and self-tapping screw 34 is fastened to the wall by being screwed into a wooden beam 46 extending between studs 47 of the drywall. Alternatively, screw 34 can be screwed directly into a stud, or, if desired a steel channel 48 can also be secured to the wall to assist in retention of the attachment member to the supporting body. It should be understood that the drywall 14 is intended to be exemplary only of the numerous types of supporting bodies with which the mounting system of the present invention can be used. Other supporting bodies can include masonry walls, stone pillars and various steel struts and beams as are commonly used in the construction industry.

After tile 10 has been firmly anchored to wall 14, groove 22 in tile 12 is lined up with the projecting section 38 of formed wire clip 32 and moved upwardly in FIG. 1 in the direction indicated by arrow 45 until the projecting section of the clip is fully received in the groove and the edge 23 of tile 12 impinges on raised section 38 of the clip.

The interlocking of the two tiles by the anchor member of the present invention creates a locked joint that firmly retains both tiles 10 and 12 in a fixed position with respect to wall 14 and, at the same time, securely anchors the tiles to the wall.

Although not illustrated, the tiles 10 and 12 are each preferably provided with two spaced grooves which extend parallel to one another from the edges 23 to receive two anchor members so that the anchor members will additionally function to align the two tiles with respect to one another and maintain a uniform spacing therebetween.

Figure 5A:
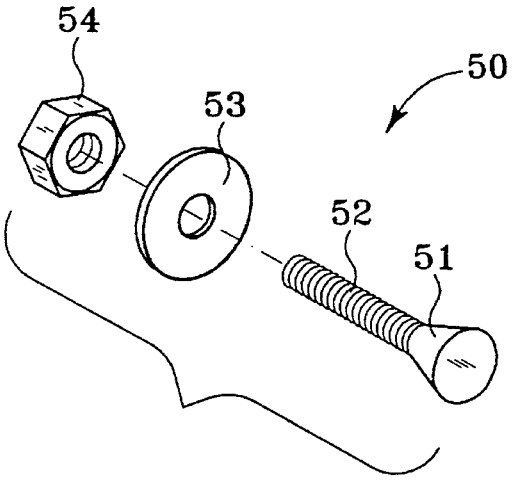
FIG. 5A is an exploded view illustrating a tile mounting system according to a second presently preferred embodiment of the invention.

FIGS. 5A–7 illustrate a tile mounting system according to a second presently preferred embodiment of the invention. With reference to FIG. 5A, the tile mounting system according to the second embodiment comprises an anchor member 50 which includes an insert portion 51 in the form of a conical-shaped body and an attachment portion 52 usually in the form of a threaded rod, which is integral with and which extends from the top end of the conical-shaped insert portion 51. As shown, for example, in FIGS. 6 and 7, conical insert portion 51 is configured to be received within a groove, such as groove 56 in FIG. 6, formed in the back surface of tile 60 and which has an undercut cross-section which is similar to the cross-sectional shape of insert portion 51

Figure 6:
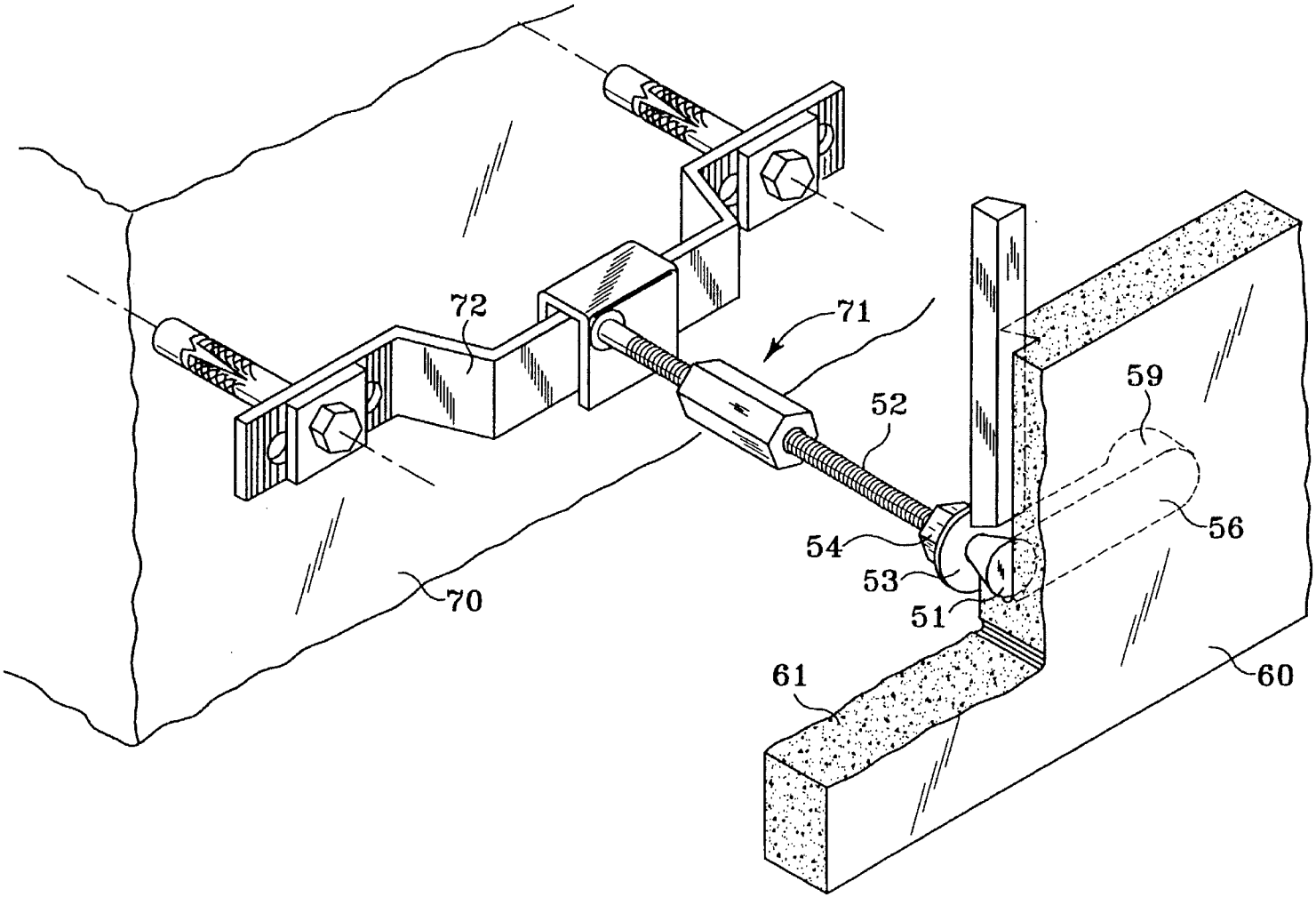
FIGS. 6 and 7 illustrate various versions of the tile mounting system according to the second presently preferred embodiment of the invention.
Figure 7:
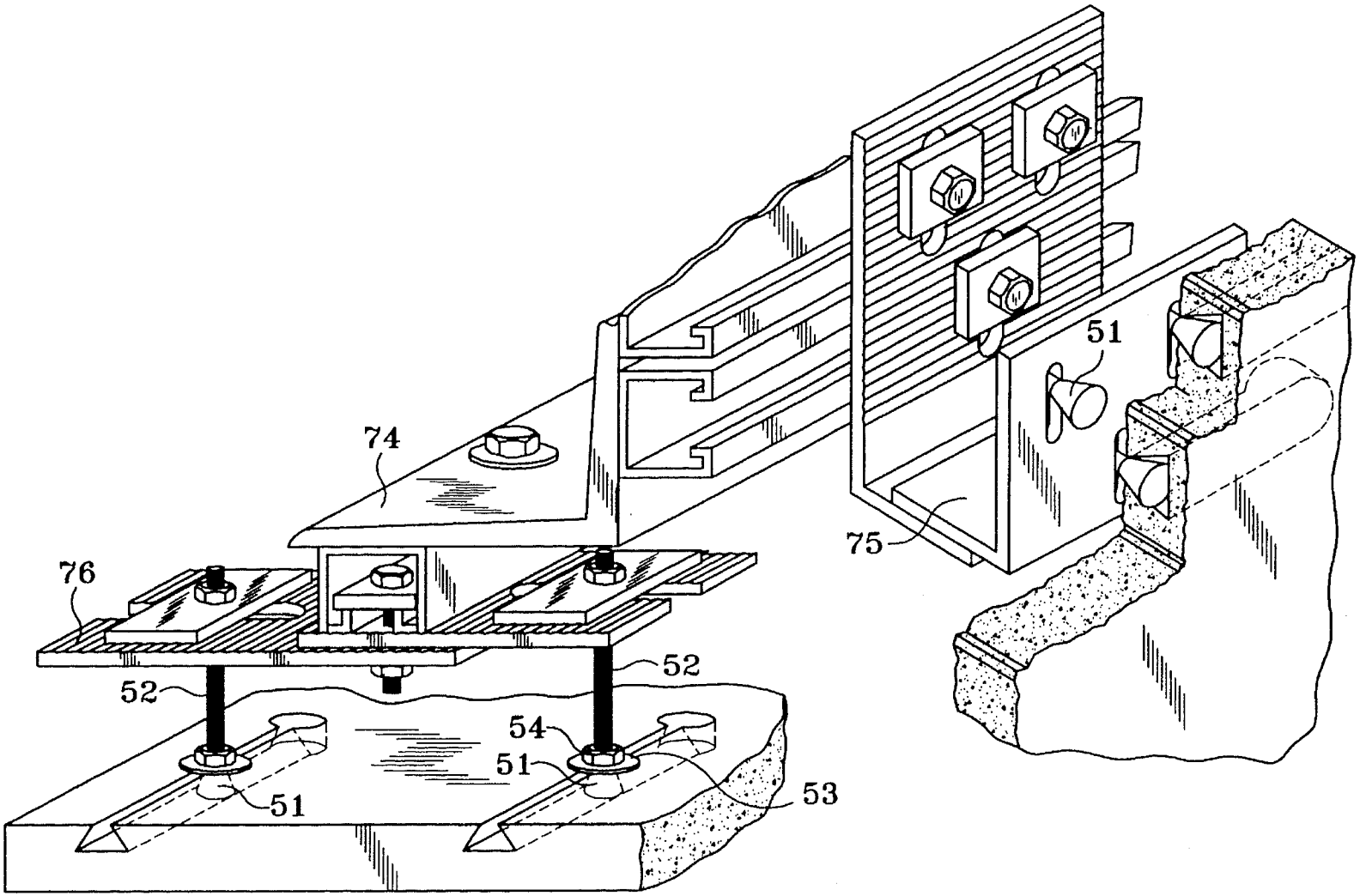

As shown in FIGS. 5A, 6 and 7, the tile mounting system also includes a washer 53 and a locknut 54, and after the insert portion 51 of anchor member 50 is inserted into and positioned within the groove, the insert portion is fixedly secured therein by first inserting washer 53 onto threaded rod attachment portion 52 and then threading the locknut 54 onto the rod until the locknut firmly presses the washer against the rear surface 61 of the tile.

After securing the insert portion 51 to a tile, attachment portion 52 is then fastened to a supporting body in any appropriate manner to mount the tile in a fixed position relative to the supporting body and to simultaneously anchor the tile to the body. For example, as shown in FIG. 6, attachment portion 52 can be fastened to a wall 70 such as a masonry wall via a stub coupling 71 and a wall handle 72 that is anchored to the wall. Alternatively, as shown in FIG. 7, the attachment portion 52 can be mounted to a beam 74 by being bolted to a bracket 75 or to a steel plate 76 or to another suitable structure attached to the beam. As also shown in FIG. 7, a tile can also be mounted to a supporting body by two or more anchor members depending on the requirements of a particular application.

An important feature of the tile mounting system of FIGS. 5A–7 is that the undercut groove need not be formed in an edge of a tile, but can be positioned at any desired location on the back face of a tile. For example, as shown in FIG. 6, groove 56 is positioned at a central location in the rear face of the tile 60. This feature provides great flexibility in permitting individual tiles to be mounted and anchored to supporting bodies of diverse type.

As also shown in FIG. 6, when a groove is provided at a central location on the rear face of the tile, it is also provided with an enlarged portion 59 at one or both ends thereof to permit the conical-shaped insert portion of the anchor member to be inserted into the groove at the enlarged portion and then slid laterally to an undercut portion of the groove at which the insert portion is fixedly secured in position within the groove.

Figure 8:
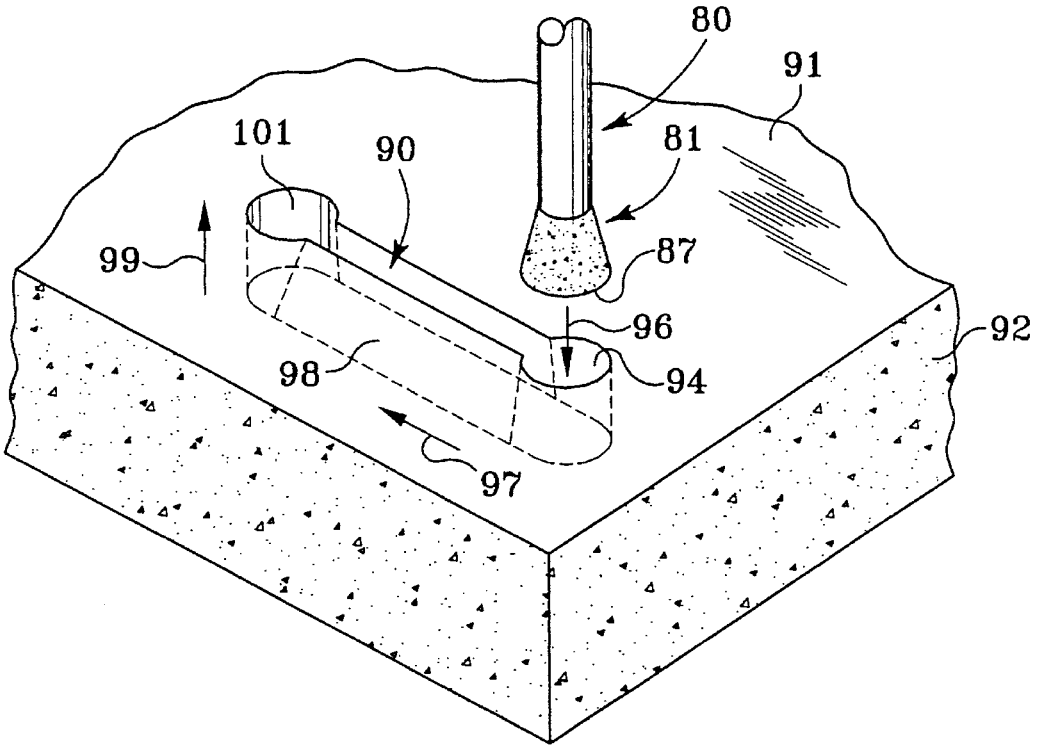
FIG. 8 illustrates a drill bit for drilling a dovetail or undercut groove in a tile according to a further aspect of the invention.

In this regard, FIG. 8 illustrates a further important aspect of the invention. Specifically, FIG. 8 illustrates a drill bit 80 for drilling a groove having an undercut portion in the rear face of a tile of stone or other material, and is particularly effective in drilling a groove which does not extend to an edge of the tile. As shown in FIG. 8, the drill bit has a drilling head 81 of diamond or other suitable drilling material which is of generally frustoconical shape and which includes a flat bottom surface 87 and a frustoconical side surface 83, both of which function as drilling surfaces. To form an undercut groove such as groove 90 in the rear face 91 of a stone tile 92, the drill bit is first driven into the tile from the rear face in a direction perpendicular to the rear face as indicated by arrow 96 to form a cylindrical groove portion 94 of a desired depth. Thereafter, the drill bit is moved laterally as indicated by arrow 97 to form the elongated undercut portion 98 of the groove. Then the drill bit can be drawn upwardly in the direction indicated by arrow 99 to form a second cylindrical groove portion 101 at the other end of the groove and to remove the drill bit from the groove; or, alternatively, the bit can be returned to its original point of entry in the tile for removal if a cylindrical groove portion is desired at only one end of the groove.

The drill bit illustrated in FIG. 8 permits grooves having undercut portions to be formed quickly and easily at any desired location on a tile. The precise shape of the drilling head can, of course, be greatly varied to produce undercut grooves of substantially any desired profile.

Figure 5B:
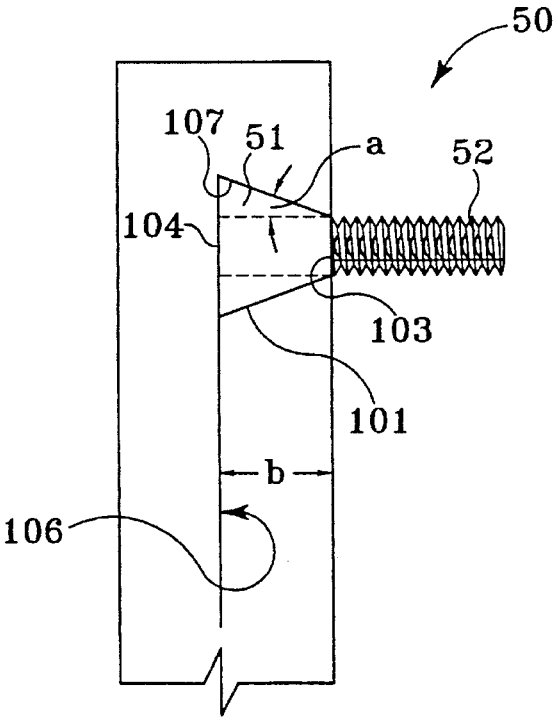
FIG. 5B schematically illustrates important features of the tile mounting system of FIG. 5A.

FIG. 5B illustrates an important feature of the tile mounting system according to second preferred embodiment of the invention. In particular, as shown in FIG. 5B, the conical-shaped insert portion 51 of anchor member 50 is integral With and extends from an end of the threaded attachment portion 52. As illustrated, the side wall 101 of the insert portion slants outwardly from the threaded attachment portion from the top end 103 thereof where the insert portion 51 meets the attachment portion 52 to the base end 104 thereof at an angle "a" of from about 12 degrees to about 15 degrees, most preferably at an angle of about 14 degrees. In addition, the undercut groove 106 in the tile is formed such that at least a portion of its side wall 107 is slanted at the same angle "a" so as to fully engage and precisely mate with the side wall 101 of the insert portion. In addition, the undercut groove is cut to a depth "b" which is precisely equal to the length of the conical-shaped insert portion 51 from top end 103 to base end 104 as shown in FIG. 5B so that the insert portion will extend fully within the groove i106 to top end 103 thereof and the attachment portion 52 will be positioned fully outside the groove when the anchor member 50 is inserted ! into the groove.

By designing the conical-shaped portion 51 to have the precise geometrical shape described above, the dynamic strength of the pull-out ratio of the anchor member 50 is significantly increased relative to conventional, standard-headed fasteners that are commonly used to mount tiles to a supporting surface. Dynamic tests utilizing tiles of stone and other varying materials at varying depths and with varying diameters of conical shape that remain within the above-described geometrical shape have been found to always provide greater strength than conventional off-the-shelf type fasteners of various Shape and size.

In this regard, it is known (see, for example, U.S. Pat. No. 4,020,610 of Alexander) to use standard off-the-shelf type flat-head screws to mount a tile to a supporting surface. In such known mounting systems, it has always been considered that the threaded portion of the screw functions to anchor the tile to the supporting surface while the conical-shaped head of the screw functions to support the tile. The applicant has discovered, however, that by utilizing an anchor member incorporating a precisely configured conical-shaped insert portion as described above and a threaded rod or other attachment portion in conjunction with an undercut groove precisely sized and configured to properly mate with the insert portion, the entire anchor member including the insert portion and the attachment portion functions as an anchor so as to provide structural strength of maximum capacity for the anchor.

Figure 9:
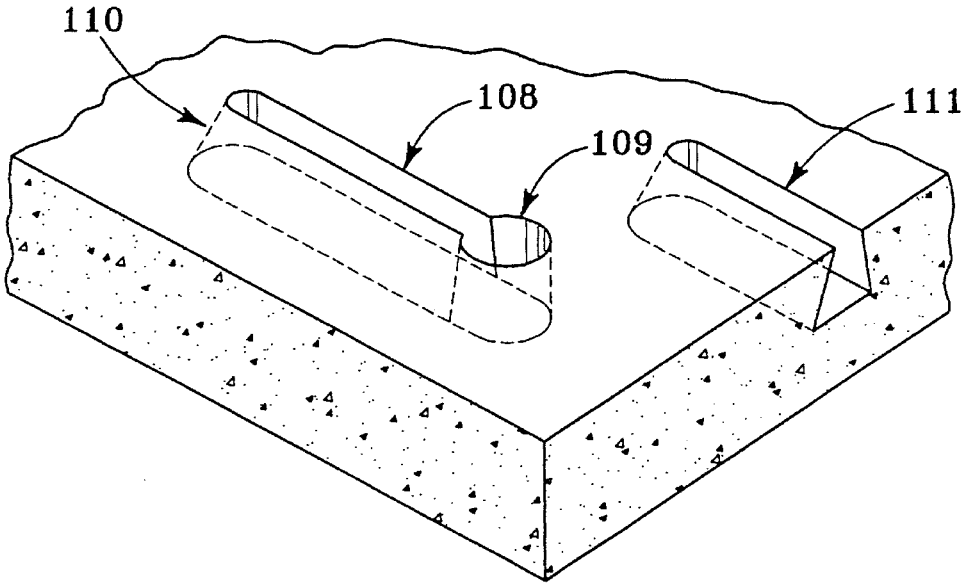
FIG. 9 illustrates various undercut groove configurations which may be utilized in the tile mounting system of FIGS. 5A–7.

FIGS. 8 and 9 illustrate exemplary undercut groove configurations which may be used in the tile mounting system of FIGS. 5A–7. In FIG. 8, an undercut groove 90 is illustrated which is enlarged at both ends so that a conical-shaped insert poirtion may be inserted into and removed from the tile either end. FIG. 9 illustrates an undercut groove 108 which is enlarged at only one end 109 and which includes a side wall 110 at the opposite end which is slanted toi precisely mate with the side wall of insert,portion 51 of the anchor member 50 of FIG. 5A. FIG. 9 also illustrates a groove 111 wherein the groove extends to an edge of the tile such that insert portion 51 may be inserted from the edge of the tile.

Figure 10:
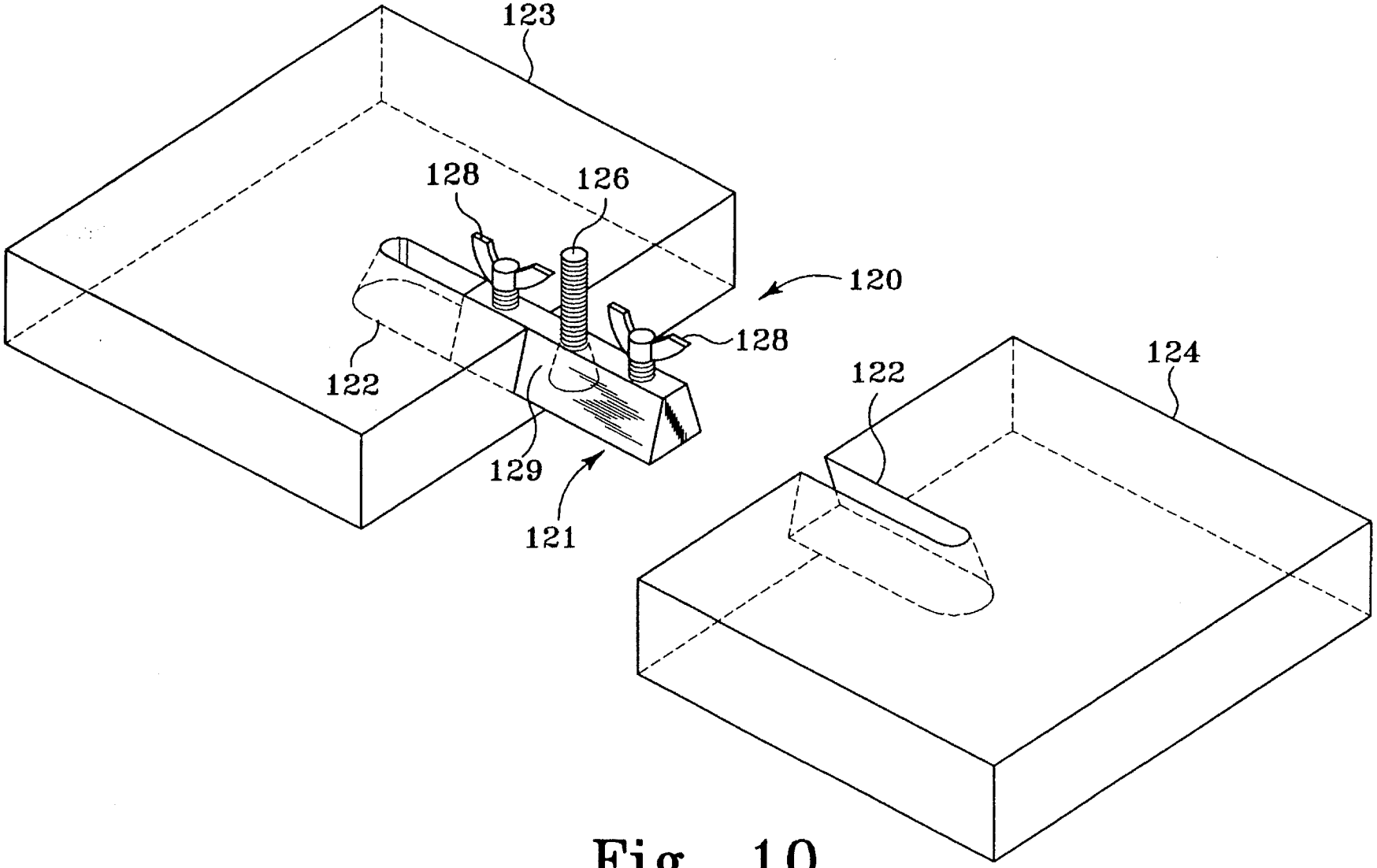
FIG. 10 illustrates a tile mounting system according to a third presently preferred embodiment of the invention.

FIG. 10 illustrates a tile mounting system according to a third embodiment of the present invention. FIG. 10 illustrates an anchor member 120 which includes an insert portion 121 in the form of an elongated solid body which is sized and shaped so as to substantially completely fill the undercut grooves 122 in each of a pair of adjacent tiles 123 and 124 so as to interlock the two tiles to one another and to mount and firmly anchor the tiles to a supporting body.

The attachment portion of anchor member 120 may comprise a threaded rod 126 or the like, as illustrated in FIG. 10, which is integral with or is extended through a hole in the insert portion for attachment of the anchor member to a supporting body. Preferably, also, a pair of spaced leveling screws 128 are mounted in threaded holes in the insert portion for proper positioning of the insert portion in the grooves.

For maximum anchoring strength, the side edges 129 of insert portion 121 are preferably slanted at an angle of from about 12 degrees to about 15 degrees as in the embodiment of FIGS. 5A–7 so as to engage and precisely mate with correspondingly slanted side walls in the undercut groove.

While what has been described constitutes presently preferred embodiments of the invention, it should be recognized that the invention could take numerous other forms. Accordingly, it should be understood that the invention is to be limited only insofar as is required by the scope of the following claims.

I claim:

1. A tile mounting system comprising:

a tile having a front face and a rear face, the rear face of said tile having an elongated groove extending substantially laterally of the tile and inwardly into said tile from the rear face, at least a portion of said groove being undercut in cross-section, a side wall of said undercut groove portion being slanted inwardly at an angle from a base of said groove to said rear face of said tile; and an anchor member for both mounting and anchoring said tile to a supporting body, said anchor member including an insert portion for being mechanically fixedly secured within said undercut groove portion of said groove at a location spaced from and between opposite ends of said groove without the use of cement mortar or like bonding agent and having a side wall slanted at substantially the same angle as said side wall of said undercut groove portion to engage with said side wall of said undercut groove portion when said insert portion is mechanically fixedly secured within said undercut groove portion, and an attachment portion extending from said insert portion in a direction substantially perpendicular to the rear face of said tile when said insert portion is fixedly secured within said undercut groove portion, said attachment portion being at least partially threaded for being threadedly attached to said supporting body.

2. The tile mounting system of claim 1, wherein said insert portion comprises a conical-shaped insert portion, and wherein said undercut groove portion is cut to a depth substantially equal to the length of said conical-shaped insert portion.

3. The tile mounting system of clam 1 and further including a locking mechanism for mechically fixedly securing said insert portion within said undercut groove portion.

4. The tile mounting system of claim 3 wherein said locking mechanism includes a washer, and a locknut threaded onto said attachment portion to press said washer against said rear face.

5. The tile mounting system of claim 1 and further including an attachment mechanism for mechanically attaching said attachment portion to said supporting body without the use of cement mortar or like bonding agent.

6. A tile mounting system comprising:

a tile having a front face and a rear face, the rear face of said tile having an elongated groove extending substantially laterally of the tile and inwardly into said tile from the rear face, at least a portion of said groove being undercut in cross-section, a side wall of said undercut groove portion being slanted inwardly at an angle from a base of said groove to said rear face of said tile;

an anchor member for both mounting and anchoring said tile to a supporting body, said anchor member including an insert portion for being fixedly secured within said undercut groove portion of said groove at a location spaced from and between opposite ends of said groove without the use of cement mortar or like bonding agent and having a side wall slanted at substantially the same angle as said side wall of said undercut groove portion when said insert portion is fixedly secured within said undercut groove portion, and an attachment portion extending from said insert portion in a direction substantially perpendicular to the rear face of said tile when said insert portion is fixedly secured within said undercut groove portion for being fixedly attached to said supporting body without the use or cement mortar or like bonding agent;

a locking mechanism for mechanically fixedly securing said insert portion within said undercut groove portion without the use of cement mortar or like bonding agent; and an attachment mechanism for mechanically fixedly attaching said attachment portion to said supporting body without the use of cement mortar or like bonding agent.

7. A tile mounting system comprising:

a tile having a front face and a rear face, the rear face of said tile having an elongated groove extending substantially laterally of the tile, said elongated groove being undercut in cross-section along substantially its entire length and having side walls which are slanted inwardly at an angle from a base of said groove toward the rear face of said tile; and an anchor member for both mounting and anchoring said tile to a supporting body, said anchor member including an insert portion for being fixedly secured within said groove without the use of cement mortar or like bonding agent, said insert portion comprising an elongated solid body sized and configured to substantially fill said groove when said insert portion is fixedly secured within said groove and having side walls which are slanted at substantially the same angle as the side walls of said elongated groove so that said side walls of said insert portion engage the side walls of said groove when said insert portion is fixedly secured within said groove, and an attachment portion extending from said insert portion in a direction substantially perpendicular to the rear face of said tile when said insert portion is fixedly secured within said groove, said attachment portion being at least partially threaded for being threadedly attached to said supporting body.

8. The tile mounting system of claim 7, wherein said side walls of said groove and said side walls of said insert portion are slanted at an angle of about 12 degrees to about 15 degrees.

9.A tile mounting system of claim 7, wherein said insert portion is sized and configured to substantially fill undercut elongated grooves in each of a pair of adjacent tiles so as to interlock said pair of adjacent tiles to one another and to mount and anchor said pair of adjacent tiles to said supporting body.

* * * * *

UNITED STATES PATENT AND TRADEMARK OFFICE

CERTIFICATE OF CORRECTION

PATENT NO. 5,555,690 Sheet 1 of 2

DATED September 17, 1996

INVENTOR(S) Edward Cosentino

It is certified that error appears in the above-indentified patent and that said Letters Patent is hereby corrected as shown below:

In Col. 1, line 62, delete "!".

In Col. 2, line 19, change "Of" to --of--.

In Col. 3, line 61, change "Which" to --which--.

In Col. 4, line 4, change "AS" to --As--.

In Col. 4, line 22, change "." (period) to --#--.

In Col. 4, line 22, change "iS" to --is--.

In Col. 6, line 12, change "With" to --with--.

In Col. 6, line 26, before 106, delete "i".

In Col. 6, line 29, after "inserted", delete "!" (exclamation point).

In Col. 6, line 41, change "Shape" to --shape--.

In Col. 6, line 66, change "toi" to --to--.

UNITED STATES PATENT AND TRADEMARK OFFICE

CERTIFICATE OF CORRECTION

PATENT NO. : 5,555,690 Sheet 2 of 2

DATED : September 17, 1996

INVENTOR(S) : Edward Cosentino

It is certified that error appears in the above-indentified patent and that said Letters Patent is hereby corrected as shown below:

In Col. 8, line 30, change "or" to --of--.

Signed and Sealed this

First Day of April, 1997

Bruce Lehman

*Attest:*

BRUCE LEHMAN

*Attesting Officer*

*Commissioner of Patents and Trademarks*